United States Patent [19]

Rees et al.

[11] Patent Number: 4,937,636

[45] Date of Patent: Jun. 26, 1990

[54] SINGLE PASS, TWO-COLOR ELECTROPHOTOGRAPHIC REPRODUCTION MACHINE

[75] Inventors: James D. Rees, Pittsford; Richard F. Lehamn, Webster, both of N.Y.

[73] Assignee: Xerox Corporation, Stamford, Conn.

[21] Appl. No.: 282,727

[22] Filed: Dec. 12, 1988

[51] Int. Cl.[5] ..... G03G 15/01

[52] U.S. Cl. ..... 355/328; 355/326

[58] Field of Search ..... 355/326, 328, 327, 71, 355/201; 430/44, 42

[56] References Cited

U.S. PATENT DOCUMENTS

| | | | |
|---|---|---|---|
| 4,068,938 | 1/1978 | Robertson | 55/4 |
| 4,078,929 | 3/1978 | Gundlach | 430/42 |
| 4,090,786 | 5/1978 | Bobbe | 355/328 |
| 4,189,224 | 2/1980 | Sakai | 355/4 |
| 4,264,185 | 4/1981 | Ohta | 355/4 |
| 4,335,194 | 6/1982 | Sakai | 430/42 |
| 4,479,242 | 10/1984 | Kurata | 382/17 |
| 4,509,850 | 4/1985 | Weigl | 355/4 |
| 4,562,129 | 12/1985 | Tanaka et al. | 430/42 |
| 4,731,634 | 3/1988 | Stark | 355/328 |
| 4,761,670 | 8/1988 | Tanaka et al. | 355/327 |
| 4,777,510 | 10/1988 | Russel | 355/328 |
| 4,849,795 | 7/1989 | Spehrley, Jr. et l. | 355/327 X |

FOREIGN PATENT DOCUMENTS

| | | | |
|---|---|---|---|
| 0121623 | 10/1978 | Japan | 355/326 |

*Primary Examiner*—A. T. Grimley
*Assistant Examiner*—Nestor R. Ramirez

[57] ABSTRACT

A reproduction device forms a two-color output copy in a single pass mode. An original document, modified by the formation of a colored fluorescent material on selected portions thereof, is illuminated by a light source. The light reflected from the document is transmitted through a colored filter and is projected onto the surface of a monopolar photoreceptor. Light incident on a fluorescent material is absorbed over a specific wavelength range and is re-admitted at a higher wavelength. This light, and light reflected from the white background, are transmitted through a filter of a color associated with the re-emited wavelength. Light reaching the photoreceptor discharges charged areas thereon at two energy levels. The resulting latent image incorporates three separate discharge levels corresponding to the black image information, color fluorescent areas, and background areas. The black and color areas are developed with appropriate colored toner by developer units biased at the appropriate levels.

8 Claims, 3 Drawing Sheets

BLACK IMAGE AREAS

RED IMAGE AREAS (INCLUDES RED FLUORESCENCE)

BLACK IMAGE AREAS

WHITE BACKGROUND

RED IMAGE AREAS

SINGLE PASS, TWO-COLOR ELECTROPHOTOGRAPHIC REPRODUCTION MACHINE

This invention relates generally to an electrophotographic reproduction machine, and, more particularly, to a reproduction machine which reproduces information in two different colors.

In a business office environment it is frequently desirable to reproduce at high speeds original documents containing highlighted portions. Typically the original document will have information in red and black. It is well known in the art to produce two color output copies using a multi-pass system, a present commercial example being the Canon 3625 copier. For this type of system, an operator utilizes a mimic-type electronic edit pad to delineate areas of an original it is desired to highlight. The coordinates of a selected area are entered into machine memory. During a first exposure cycle all areas on the photoreceptor are erased save the selected highlight color area which is then subsequently developed with the appropriate color toner. The resulting image is transferred to a copy sheet, fused and returned to the developer station entrance zone where it is re-registered. A second exposure of the original is made and the highlight area only is erased. The resulting latent image is developed with conventional black toner, and transferred to the copy sheet which is then fused and the copy sheet conveyed to an output tray.

The type of system exemplified by the Canon 3625 has several disadvantages; it requires an expensive electronic component, the edit pad as well as additional memory. Registration following the first exposure is difficult to achieve. Since the system is two cycle (two pass) the productivity is limited. It is therefore highly desirable for an electrophotographic reproduction machine to reproduce both the black and the color (red for most highlighting purposes) information in a single pass. By single pass, it is meant that a composite electrostatic latent image having regions corresponding to the red information and black information is recorded on the photoconductive surface. This composite electrostatic latent image is developed with black and red toner particles to produce a two-color toner powder image. This two-color powder image is subsequently transferred to the copy sheet and permanently affixed thereto. In this way, a highlighted color copy of the original document may be readily produced at relatively high speeds, automatically and in perfect registration.

Numerous other approaches have been devised in the prior art for producing highlight color copies. The following disclosure appear to be relevant.

U.S. Pat. No. 3,832,170 Nagamatsu et al., describes a photosensitive member having an insulating layer acting as a color filter. The photoconductive drum is divided into three segments, each segment corresponding to a different colored electrostatic latent image. These differently colored electrostatic latent images are then developed by toner particles complementary in color thereto. The toner powder images are then transferred to a copy sheet in superimposed registration to form a multicolor copy corresponding to the original document.

U.S. Pat. No. 4,078,929 Gundlach, discloses a reproduction machine which can form a two color copy of an original document either using conventional light lens exposure techniques, or electronically. A charge pattern of a single polarity and having at least three different levels of potential is formed on a photoreceptor and developed in two colors by utilizing relatively negatively charged toner particles of one color and relatively positively charged toner particles of a second color. The exposure system requires the use of black and white images on an original document having a intermediate (grey) color.

U.S. Pat. No. 4,189,224 Sakai, discloses a photoconductive drum formed with first and second photoconductive layers of different spectral sensitivities. The photoconductive drum is charged and exposed causing electrostatic latent images to be formed on the respective layers according to the color within the original document. The charges of the latent images are of opposite polarity. Toner particles, similarly of opposite polarity, are used to develop the respective latent images. The toner particles of different colors. In this way, a two-color copy is formed.

U.S. Pat. No. 4,264,185 Ohta, describes an electrophotographic printing machine employing a photoconductive drum formed with at least two photoconductive layers of different spectral sensitivities. One layer may be panchromatic with the other layer being insensitive to red light. The drum is charged, at least twice, with opposite polarities to produce the charge pattern. A light image of the original document then exposes the charged regions of the drum. This results in positive and negative electrostatic latent images being recorded thereon. The latent images are developed with black and red toner particles of opposite polarity to form a two-color copy.

U.S. Pat. No. 4,335,194, Sakai, discloses a photoconductive member comprising a red sensitive photoconductive layer and a red-insensitive photoconductive layer. Two colors are printed by charging and exposing to white light, irradiating with red light and charging to an opposite polarity, charging to the same polarity as an opposite polarity, charging to the same polarity as the first polarity, and developing with red and black toners of opposite polarity.

U.S. Pat. No. 4,509,850, Weigl, teaches an electrophotographic printing machine capable of reproducing both black information and red information in a single pass. A continuously charged area and a modulated charged area are recorded onto a photoconductive surface. The modulated charged area is developed with polar or polarizable marking particles of a first color while the continuously charged area is developed with charged marking particles of a second color.

U.S. Pat. No. 4,479,242, Kurata, discloses a dichromatic reading device capable of separating a specific color from other colors of and original document. An electric circuit is provided which obtains the difference between the level of an image signal readout without a filter, and the level of a signal readout through a complementary filter for the specific color. Subsequently, an image signal for the specific color is produced from the difference.

U.S. Pat. No. 4,068,938, Robertson, teaches an electrophotographic printing machine capable of reproducing two color copies from a two color original document. An electrostatic latent image having three discrete potential levels is recorded onto a photoconductive drum. A high level is developed by particles of a first color corresponding to a dark color of the original document and a low level is developed by particles of a second color. The underdeveloped portion remains the color of the sheet of support material.

U.S. Pat. No. 4,562,129, Tanaka, discloses a bipolar photoreceptor which permits three different potential levels to be formed thereon.

From the discussion above it can be seen that those systems which utilize a single pass highlight color system (e.g. Gundlach) require the formation of separate levels of photo conductor discharge. One level (high) corresponds to black information, an intermediate level corresponds to white background and a third level (low) corresponds to the highlight color (red). The majority of the other prior art references cited above disclose some kind of bi-polar photoreceptor comprising multiple layers, each layer sensitive to a different color. The black and red discharge areas are then developed by developer units biased to appropriate levels. It would be desirable to enable a single pass color highlight system which does not require a bi-polar photoreceptor. It would also be desirable for the system to utilize a conventional light lens scanning system to make highlight color copies of originals having normal red and black images on a white background (unlike, for example, Gundlach which makes two color copies either from a CRT display or from an original with a grey background). According to the present invention a multi-level electrostatic potential image is derived from an original which has been modified by applying a fluorescent dye or pigment of a desired color and in a selected pattern onto a black and white original document. For a preferred embodiment a red fluorescent pigment is applied to the original. The original is illuminated in a lamp source with a white light emission and a red filter is placed in the imaging path. Light reflected from the original document and passing through the filter will create a three charge level pattern at the photoreceptor. Light reflected from black areas will leave undischarged areas (high level); light reflected from white background areas will result in a lower discharge level. Light incident on the fluorescent pigment excites the pigment causing the low level incident light to be re-emitted as red light. This, plus the red reflected in the normal manner, generates a higher apparent reflectivity than the white paper, (a "whiter" than "white" effect). This red enhanced emission discharges the photoreceptor to a third level lower than the white background level. This three level charge pattern is then developed and an output two color copy is produced by application of known xerographic techniques.

IN THE DRAWINGS

Figure 2:
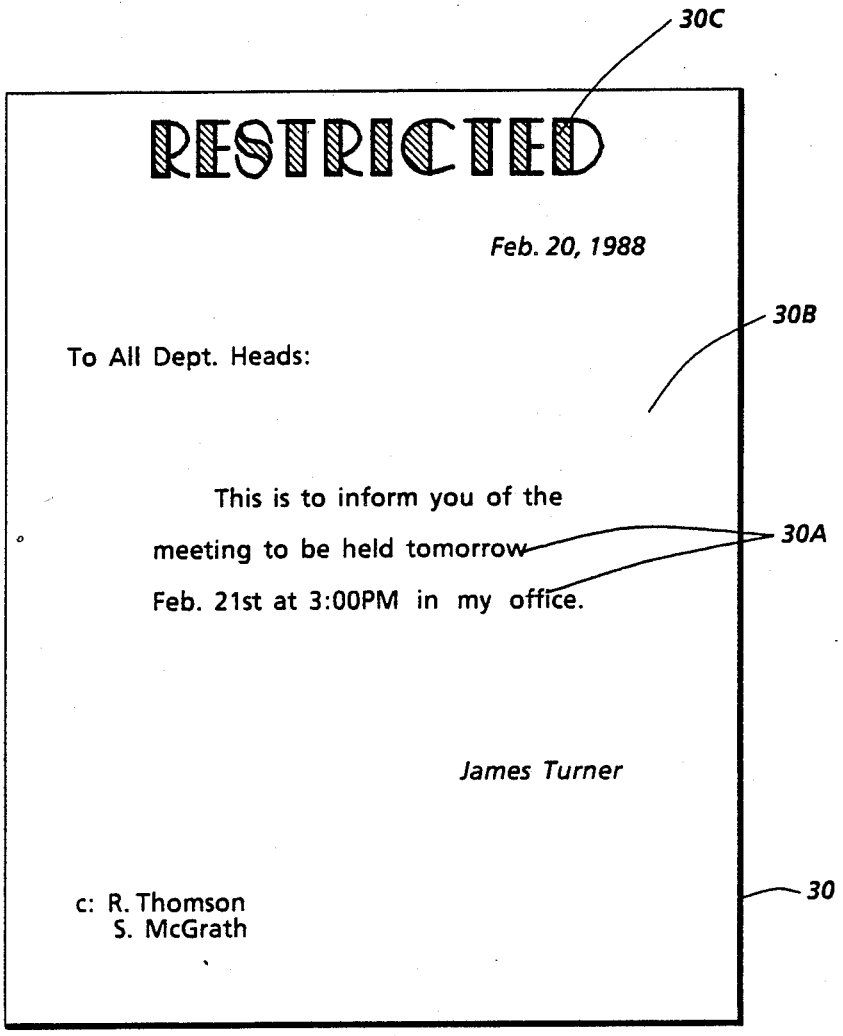
FIG. 2 represents an original document showing an area formed by application of a fluorescent dye or pigment of a selected color.

FIGS. 4, 4*a*, 4*b*, 4*c* show light absorbance and reflection from the black, white background and fluorescent areas of the original document of FIG. 2.

Figure 5A:
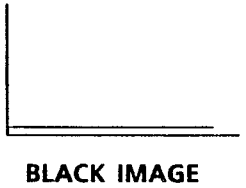
Figure 5B:
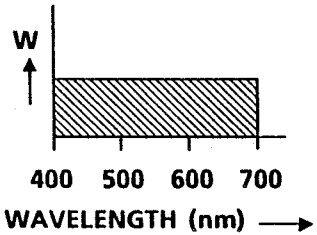
Figure 5C:
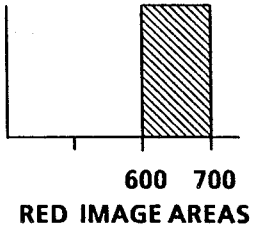

FIGS. 5*a*, 5*b* and 5*c* show the relative emission level over the selected wavelength range.

FIG. 6 shows relative emission over the selected wavelength after a filtering step.

Figure 7:
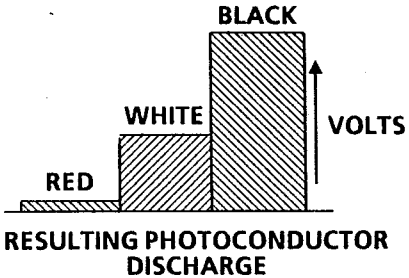

FIG. 7 shows three separate discharge levels at the photoreceptor following a document scan cycle.

DESCRIPTION OF THE INVENTION

Figure 1:
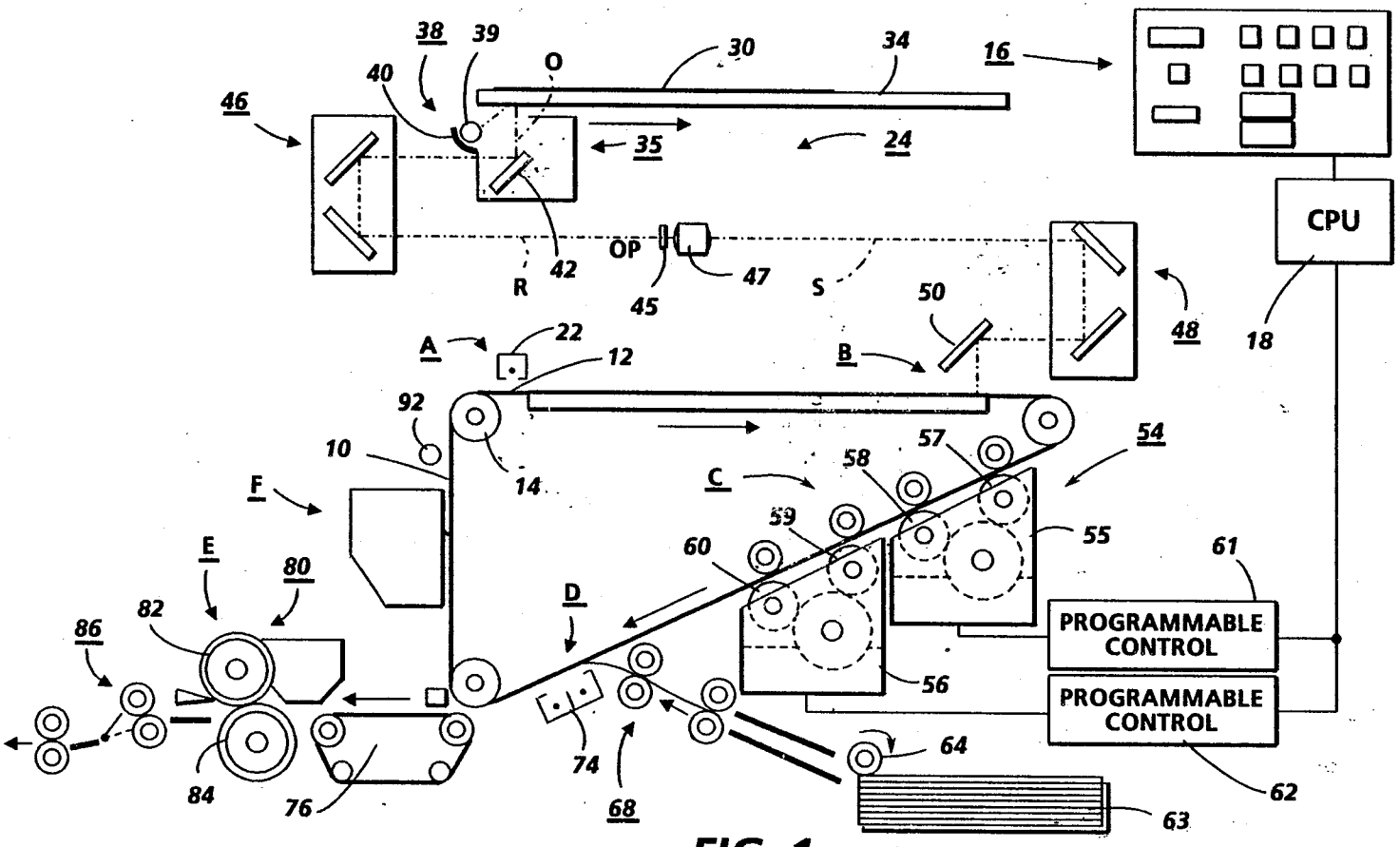
FIG. 1 is a schematic elevational view showing an electrophotographic printing machine incorporating the highlight color system of the present invention.

FIG. 1 illustrates a preferred embodiment of an imaging system which is used to produce a two color output copy, in a single cycle scan (pass) of an original document modified according to the invention. It will be understood that it is not intended to limit the invention to that embodiment. On the contrary, it is intended to cover all alternatives, modifications and equivalents as may be included within the spirit and scope of the invention as defined by the appended claims.

Turning now to FIG. 1, the electrophotographic printing machine uses a monopolar photoreceptor belt 10 having a photoconductive surface 12 formed on a conductive substrate. Belt 10 moves in the indicated direction, advancing sequentially through the various xerographic process stations. The belt is entrained about a drive roller 14 and two tension rollers.

In operation, the operator may select the number of copies being reproduced as well as of adjusting any of the parameters within the various processing stations. This is achieved by keying in the required adjustment and number of copies at the control panel, indicated generally by the reference numeral 16. Control panel 16 is electrically coupled to a centralized processing unit, indicated generally by the reference numeral 18. Preferably, centralized processing unit (CPU) 18 is a microprocessor made by Intel Corporation under the Model No. 8086. CPU 18 is electrically connected to the various processing stations within the electrophotographic printing machine so as to control their operation.

With continued reference to FIG. 1, a portion of belt 10 passes through charging station A where a corona generating device, indicated generally by the reference numeral 22, charges photoconductive surface 12 to relative high, substantially uniform, negative potential.

Next, the charged portion of photoconductive surface 12 is advanced through an imaging station B. The imaging station includes an exposure system, indicated generally by the reference numeral 24. An original document 30, modified according to one aspect of the invention, is positioned face down on a transparent platen 34. An example of an original document 30 is shown in FIG. 2. The document has black, informational text areas 30A, white background areas 30B and a second informational area 30C formed, in this embodiment, by applying a red fluorescent pigment through a stencil.

At development station C, a magnetic brush development system, indicated generally by the reference numeral 54 advances developer materials into contact with the electrostatic latent images. The development system 54 comprises first and second developer stations including housings 55 and 56. Preferably, each magnetic brush development housing includes a pair of magnetic brush developer rollers. Thus, the housing 55 contains a pair of rollers 57, 58 while the housing 56 contains a pair of magnetic brush rollers 59, 50. Each pair of rollers advances its respective developer material into contact with the latent image. Each developer roller pair forms a brush-like structure comprising toner particles which are attracted therefrom by the latent electrostatic images on the photoreceptor. For the sake of illustration, housing 55 contains developer with black toner having triboelectric properties such that the toner is driven to the most highly charged areas of the latent image. Housing 56 contains developer with colored (red) toner having triboelectric charge properties such that the toner is urged towards parts of the latent image area having a charge representative of the area correspondly to the area of the original covered with the red pigment Appropriate developer biasing is accomplished via programmable power controls 61 and 62 electrically connected to respective developer housings 55 and 60 and to CPU 18. An appropriate program stored in fixed memory of the controller and, applied through a digital-to-analog converter (not shown), will cause the developer rolls, at the appropriate time, to rotate in one direction to effect image development or in the opposite direction for chausing the developer to cease contact with the photoreceptor. Further details of an appropriate development system are contained in U.S. patent application 07/078,743, assigned to the same assignee as the present invention, whose contents are hereby incorporated by reference.

Continuing with the system description, optics assembly 35 contains the optical components which incrementally scan-illuminate the document from left to right and project a reflected image onto surface 12 of belt 10, forming a latent image of the document thereon. Shown schematically, these optical components comprise an illumination lamp assembly 38, comprising an elongated fluorescent lamp 39 and associated reflector 40. (A fluorescent lamp is used for its white light emission characteristics; its fluorescent properties do not have any specific relation with the fluorescing pigment. For example, for a flash system a xenon flash lamp provides a white light emission. Assembly 38 and full rate scan mirror 42 are mounted on a scan carriage (not shown) adapted to travel along a path parallel to and beneath, the platen. Lamp 39, in conjunction with reflector 40, illuminates an incremental line portion of document 30. The reflected image is reflected by scan mirror 42 to corner mirror assembly 46 which is adapted to move at ½ the rate of carriage mirror 42. The document image is projected along optical path OP through a filter 45, and then through lens 47. For this embodiment, where informational area 30C is a red fluorescent dye, filter 45 will also be red. The image is then reflected by a second corner mirror assembly 48 and by belt mirror 50, onto surface 12 to form thereon an electrostatic latent image corresponding to the information areas contained within original document 30. The latent image is formed with there separate discharge levels as will be discussed below.

After development, belt 10 advances the red and black toner powder image to the transfer station D. At the transfer station, a sheet of support material is moved into contact with the powder image. The sheet of support material is advanced to transfer station D by a sheet feeding apparatus, indicated generally by the reference numeral 63. Preferably, sheet feeding apparatus 63 includes a feed roll 64 contacting the uppermost sheet of a stack of sheets. Feed roll 64 rotates in the direction of the arrow so as to advance the uppermost sheet into the nip defined by forwarding rollers 68. Forwarding rollers 68 rotate in the direction of arrow 70 to transport the sheet into contact with photoconductive surface 12 of belt 10 so that the toner powder image developed thereon contacts the advancing sheet at the transfer station.

Because the composite image developed on the photoreceptor consists of both positive and negative toner, a pre-transfer corona discharge member 74 is provided to condition the toner for effective transfer to a substrate using corona discharge. After transfer, the sheet continues to move on to fusing station E.

Fusing station E includes a fuser assembly, indicated generally by the reference numeral 80 which permanently affixes the transferred toner powder image to the sheet. Preferably, fuser assembly 80 includes a heated fuser roller 82 and a back-up roller 84. The sheet passes between fuser roller 82 and back-up roller 84 with the powder image contacting fuser roller 82. In this manner, the powder image is permanently affixed to the sheet. After fusing, forwarding rollers 86 advance the sheet to a catch tray (not shown) for subsequent removal from the printing machine by the operator.

After the red and black powder image is transferred from photoconductive surface 12 to the copy sheet, belt 10 rotates the photoconductive surface to cleaning station F. At the cleaning station a brush, cleaning system removes the residual particles adhering to photoconductive surface 12. A discharge lamp 92 is activated prior to charge.

It is believed that the foregoing description is sufficient for purposes of the present invention to illustrate the basic operation of an electrophotographic printing machine incorporating the features of the present invention therein. The formation of the three charge level latent image at the photoreceptor is now described with reference to FIGS. 3–6.

Figure 3:
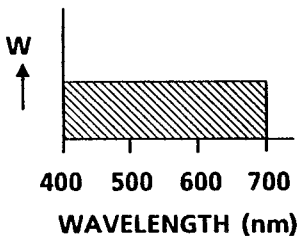
FIG. 3 shows a plot of lamp emission output over a selected wavelength range.
Figure 4A:
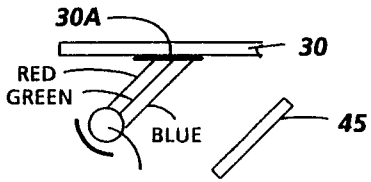
Figure 4B:
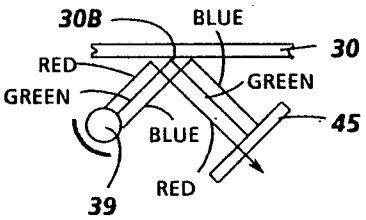
Figure 4C:
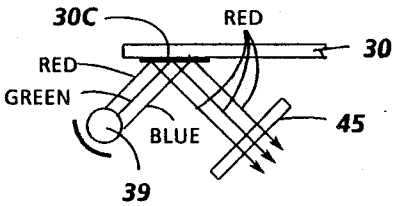
Figure 6A:
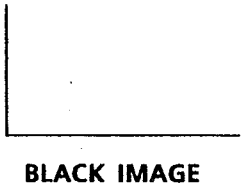
Figure 6B:
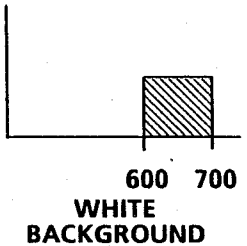
Figure 6C:
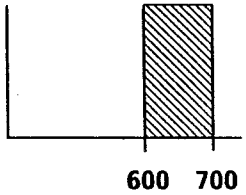

As mentioned above, lamp 39 is a fluorescent lamp having a characteristic, generally white exposure emission. Thus, the emission from lamp 39 can be considered as comprising components of light in the blue, green and red wavelengths. FIG. 3 shows a plot of the emission level over the wavelength range of 400–700 nm. This output from lamp 39 illuminates original document 30 and a reflected image of the document is incrementally transmitted, during a scan mode, along optical path OP. The reflected image at, for example point R, of FIG. 1, has three separate light components which have been formed as described with reference to FIGS. 4, 5 and 6. FIGS. 4A, 4B and 4C are simplified schematic representations showing how the light from lamp 39 is reflected from areas 30A, 30B and 30C respectively of FIG. 2. FIGS. 5A, 5B and 5C show, respectively, relative light emission outputs W over the selected wavelength. Referring then to FIG. 4A, light incident on areas 30A of FIG. 2, is completely absorbed since black absorbs all wavelengths. No light reaches filter 45 and hence, as shown in FIG. 5A, the level of light reflected from area 30A is close to zero. FIG. 4B shows that light incident on the white background areas 30B of the document is nearly uniformly reflected since the white background reflects all wavelengths. Thus the light reacing filter 45 will have a light level, FIG. 5B approximately equal to the lamp exposure levels of FIG. 3. FIG. 4C shows the light reflected from red fluorescent area 30C of FIG. 2. The red component of the incident white light is reflected as red light. However, the blue and green components are absorbed, and by virtue of the fluorescing properties of the dye, are re-emitted as light of a higher wavelength e.g. as red light. Thus, the light reaching filter 45 will be red (wavelength range of 600–700 nm) and have a level shown in FIG. 5C. Continuing with the analysis of the reflected image brightness, as the reflected image passes through the red filter 45, the red filter transmits only the light in the red area resulting in the plots shown in FIG. 6. FIGS. **6*a*, 6*b*, and 6*c* show the relative emission output, over the selected wavelength following a filtering slip. From FIG. 4A no light was reflected from the black areas; hence no light is transmitted in the red wavelength of interest as shown in FIG. 6A. From FIG. 4B only the red component of the light reflected from white background areas pass through filter 45. Thus, the level of light passing through the filter, shown in FIG. 6B is reduced from the reflected level shown in FIG. 5B by the lower wavelength component (400–600 nm) blocked by the red filter. From FIG. 4C, it is seen that, in addition to the red component of light reflected from the red fluorescent area 30C, the light components converted from blue and green into red also pass through filter 45. Thus, as shown by FIG. 6C the level of light is greater than the reflected light level of FIG. 6B. The resulting photoconductor discharge for the red image, white background and black image portions of the original document are shown in FIG. 7. It will be appreciated that, with appropriate setting of the biased levels of developers 55 and 56, developer 55 will develop the black area and developer 56** will develop the red area.

It will be appreciated that other color fluorescing materials can be used instead of the red in the preferred embodiment. One skilled in the art may match the absorption and re-emission characteristics of a fluorescent dye material with the emission characteristics of the light source and select the appropriate color filter. It will further be appreciated that the fluorescent material may also be used to selectively highlight black informational areas of a document. For example, if the red fluorescent pigment is applied to the body of the memo shown in FIG. 2, that area will be reproduced as black text on red background in the output copy.

While the original in the preferred embodiment was modified by applying the fluorescent material manually, other methods are possible for depositing the material at the desired location. As one example, a modified original may be created by forming a latent image original and developing selected areas with a fluorescent impregnated toner. Altermatively, an ink jet printer can be modified to print an output copy using black and a colored fluorescent ink. With either, or other methods, the resultant copy will then be used as the original for purposes of the invention.

While the invention has been described with reference to the structure disclosed, it is not confined to the specific details set forth but is intended to cover such modifications or changes as may come within the scope of the following claims.

What is claimed is:

1. In an electrophotographic reproduction machine for printing two color output copies of an original document in a single pass, the original document having black information on a neutral background and at least one area covered with a colored fluorescent material which absorbs incident radiation within a specific wavelength range and which re-emits the absorbed radiation at a higher wavelength range, the machine including:

a xerographic imaging system comprising a photoconductor member, means for charging the surface of said member, optical means adapted to form a latent electrostatic image of said original on the surface of said photoconductor member, said latent image having a first discharge level corresponding to the black image areas of the original document, a second discharge level corresponding to the area on the original document covered by the colored fluorescent material, and a third discharge level corresponding to the background areas of the original document, means for developing said latent image in at least two colors, means for transferring said developed image to a copy sheet, and means for fusing said transferred image.

2. The machine of claim 1, wherein said optical means including a light source for illuminating said original document, said light source having an emission component at least partly in said absorbing wavelength range, said optical system further including a filter for transmitting light reflected from said document in the fluorescent (re-emitted) light wavelength range to form said second discharge level.

3. The machine of claim 1 wherein said area of said original document covered by said fluorescent material is formed by a red fluorescent dye or pigment which absorbs radiation at wavelengths below 600 nm and re-emits the radiation over a wavelength range of approximately 600–700 nm, said filter being a red filter which transmits the radiation within the re-emitted wavelength range.

4. The machine of claim 1 wherein said fluorescent material is manually applied to the original document.

5. The machine of claim 1 wherein said area covered by said fluorescent material is formed by a development process which includes a toner incorporating a fluorescent dye.

6. The machine of claim 1 wherein said area covered by said fluorescent material is formed by an ink jet printing process utilizing black and a colored fluorescent ink.

7. The machine of claim 1 wherein the colored fluorescent material covers at least a portion of the black image information area.

8. A method for producing a two color copy of an original document in a single pass including the steps of:

creating an original document having black image areas on a neutral background and at least one area covered with a colored fluorescent material which absorbs radiation below a first wavelength and re-emits light over a second, higher wavelength range, illuminating said document with an illumination source which has at least some light components within said first wavelength range, filtering the light reflected from the document so as to transmit radiation within said second range while blocking radiation within said first wavelength range, projecting said filtered reflected light onto the surface of a monopolar photoconductor to form a latent electrostatic image thereon said latent image having a first discharge level corresponding to the black image areas of the original document, a second discharge level corresponding to the colored fluorescent area of the original document and a third discharge level corresponding to the background areas of the original document, developing said latent image with a two color developer means adapted to cause development of said first and second discharge levels with a black and color toner, transferring the two colored developed image to a copy medium, and fusing the transferred image onto the copy sheet.

* * * * *